US005974980A

United States Patent [19]

Kent

[11] Patent Number: 5,974,980

[45] Date of Patent: Nov. 2, 1999

[54] EASILY INSTALLED, ADJUSTABLE, IRONING BOARD-IN-A-DRAWER

[76] Inventor: Roger T. Kent, 480 Puuikwna, Honolulu, Hi. 96821

[21] Appl. No.: 09/236,381

[22] Filed: Jan. 25, 1999

Related U.S. Application Data

[63] Continuation-in-part of application No. 08/980,557, Nov. 10, 1997, abandoned.

[51] Int. Cl.[6] ..... A47B 5/00

[52] U.S. Cl. ..... 108/42; 108/97; 108/47

[58] Field of Search ..... 108/42, 46, 47, 108/48, 98, 97, 90, 135, 152, 33; 312/310, 235.1, 235.3, 235.2, 330.1

[56] References Cited

U.S. PATENT DOCUMENTS

| | | | |
|---|---|---|---|
| 886,361 | 5/1908 | Fiebke | 108/131 X |
| 1,953,952 | 4/1934 | Carey et al. | 108/131 X |
| 2,246,432 | 6/1941 | Cohen | 108/47 |
| 2,514,702 | 7/1950 | Lantz | 108/97 X |
| 2,814,892 | 12/1957 | Larsen | 108/48 |
| 3,669,032 | 6/1972 | Gooderum | 108/152 X |
| 5,069,142 | 12/1991 | Matre | 108/42 |
| 5,241,766 | 9/1993 | Walz et al. . | |
| 5,444,928 | 8/1995 | Sagel . | |
| 5,706,593 | 1/1998 | Allard et al. | 108/47 X |

*Primary Examiner*—Jose V. Chen
*Attorney, Agent, or Firm*—Rodger H. Flagg

[57] ABSTRACT

An ironing board which is foldable or collapsible, and which is easily installed in a new or existing drawer of a cabinet, dresser, table, or the like, includes a tapered nose board, a rectangular base board hingedly connected to the nose board to thereby form a horizontal ironing surface. A movable support member is pivotably secured to the underside of the base board. In the closed position, the movable support member is parallel to the underside of the base board. In an open position, the movable support member extends beneath the base board to support the base board above the drawer. An elastic, resilient cord is secured to the underside of the base board. A suitable tie is looped and fastened around the resilient cord, and the tie is also connected to an eye screw which in turn is screwed into the rear side of the drawer. A slide member is slidably secured to the bottom side of the base board, and extends beneath the tapered nose board to provide support to the tapered nose board when the ironing board is in an open position. The ironing board is removed and unfolded for use, and re-folded and stored in the drawer after use.

20 Claims, 5 Drawing Sheets

EASILY INSTALLED, ADJUSTABLE, IRONING BOARD-IN-A-DRAWER

CONTINUATION IN PART STATUS

This is a continuation-in-part (CIP) of co-pending patent application having Ser. No. 08/980,557, filed on Nov. 10, 1997. Said co-pending patent application to be abandoned after this CIP application is filed.

FIELD OF THE INVENTION

The present invention relates to ironing boards which are foldable or collapsible. More particularly, the invention relates to an easily installed, adjustable, ironing board adapted for installation in a drawer of a cabinet, dresser, table, or the like.

BACKGROUND OF THE INVENTION

The ironing board has long been a standard item of household equipment. The disadvantages of the standard upright ironing board are that it is a bulky device which is clumsy to handle, and time-consuming to remove from its place of storage, set up, take down after use, and return to storage. It is also unsightly and space-consuming if it is left standing after use. It is a problem in the art to provide an ironing board which is less inconvenient and less time-consuming.

Examples of such well-known devices include ironing boards which hang on a door and folds down for use; small counter-top ironing boards; full-sized ironing boards built into wall cabinets or into attachable wall cabinets; and folding and/or telescoping ironing boards of various configurations.

U.S. Pat. No. 5,241,766 to Walz et al. teaches a folding pull-out ironing board and a telescoping built-in ironing board. The mechanism for erecting the ironing board from a drawer includes four separate linkage members and a rear fastening element formed of wire rope. The linkage is fixedly fastened to the base of the drawer.

U.S. Pat. No. 5,444,928 to Sagel is directed to a telescoping built-in ironing board. The mechanism for erecting the ironing board from a drawer includes four separate linkage members and a hinged ironing board. The linkage is fixedly fastened to the base of the drawer.

U.S. Pat. No. 2,514,702 to Lantz is directed to a portable ironing board. The ironing board includes cantilevered sliding rails, and the front of the ironing board is supported by the front of a drawer. The sliding rails include a fixed rail and a cooperating sliding rail.

U.S. Pat. No. 1,953,952 to Carey et al. is directed to a combination kitchen table and ironing board. The ironing board is concealed within a table, and has a drop-down leg portion which, when opened, reaches to the floor for supporting the ironing board.

U.S. Pat. No. 886,361 to Fiebke teaches a foldable ironing board. The ironing board is connected to a table, and has a drop-down leg portion having two separate support linkages connected to the ironing board. The leg portion, when opened, reaches to the floor for supporting the ironing board.

U.S. Pat. No. 3,669,032 to Gooderum is directed to a legless ironing board. The ironing board has mounting elements to that it can be cantilevered at one end to a sliding board which is extensible from a cabinet. The ironing board itself does not fold or collapse.

U.S. Pat. No. 5,706,593 to Allard et al. teaches a compact ironing board securable to an edge. The ironing board is securable at one end to a recess such as a sink, and has a front leg which is extensible to the floor to support the front of the ironing board.

U.S. Pat. No. 2,814,892 to Larsen is directed to work tables, and particularly to ironing boards. In this patent, an ironing board is securable to an anchor assembly in a wall, and includes a pivotable support leg assembly having an adjustable length, to adapt to different heights and positions.

U.S. Pat. No. 5,069,142 to Matre is directed to a collapsible table. The table is mounted on a support linkage assembly so that it can be folded into a compact position, and selectively moved into a raised position. The table top itself is composed of hinged elements, which can be folded into a more compact shape.

U.S. Pat. No. 2,246,432 to Cohen is directed to a tray support. The tray support has a movable support structure including a pivot and spring member.

Complex arrangements of the prior art are subject to frequent malfunction, misalignment, and jamming. These inherent disadvantages detract from the objectives of such arrangements of convenience in setting up and storing the ironing board. Additionally, these boards, due to their complexity, are difficult and expensive to repair. Also, where the boards are built-in, professional installation is required at the time of cabinet construction or major canbinet renovation, and permanently replaces a drawer space. Existing drawers cannot be used in such arrangements. Such professional type of installation is frequently beyond the capability of the average home, apartment, or condominium dweller. Such devices are also incompatible with the needs of the average householder due to the difficulties and expenses of such an installation. Because of these difficulties, such divices—once installed—cannot be removed or relocated without considerable expense and inconvenience. Also, such devices may not be fully satisfactory as ironing platforms as they may be subject to vibration and shaking when ironing pressure is applied. Such devices, because of their complexity, are difficult to manufacture and therefore are prohibitively costly to the average householder wanting a more convenient, reasonably priced, ironing board. These are even more costly considering the necessary installation expenses. Also, such complex arrangements are not readily available to consumers, and instead are primarily distributed through custom cabinet supply outlets.

SUMMARY OF THE INVENTION

From the foregoing, it is seen that it is a problem in the art to provide a device overcoming the disadvantages of the prior art described above, and meeting the above requirements. According to the present invention, a device is provided which meets the aforementioned requirements and needs in the prior art. Specifically, the device according to the present invention provides an easily installed, adjustable, ironing board adapted for installation in a drawer of a cabinet, dresser, table, or the like.

An object of the present invention is to provide improved ironing convenience at reasonable cost to householders desiring the capability to quickly and conveniently iron clothing articles. Accordingly, the ironing board according to the present invention has several advantages which contribute to the achievement of the stated objective, as follows.

The ironing board according to the present invention is simply constructed with basic materials which are readily available at most hardware and lumber stores. Accordingly, as the ironing board according to the present invention is inexpensive to manufacture and requires no complicated or innovative manufacturing techniques as means of production.

The simplicity of production and low cost of materials translate into a low purchase price for consumers. This allows the ironing board according to the present invention to be easily and inexpensively repaired or replaced, if such is required.

The ironing board according to the present invention can be sized to fit into an existing top drawer having suitable minimum dimensions, and the existing drawer can be located in a cabinet, dresser, table, or in a variety of other types of furniture having a drawer.

Advantageously, the ironing board according to the present invention is not visible when stored in its drawer. Also, the simplicity of the design of the ironing board according to the present invention permits easy installation and adjustment by a typical householder, thus eliminating the cost and requirement for professional installation. The ironing board according to the present invention requires only the installation of one small eye screw.

Further, in the ironing board according to the present invention, a tension-stabilized base support system is provided which ensures a stable, movement-free and vibration-free ironing platform.

The simplicity of the manual operation of my ironing board ensures quick, reliable, and consistent deployment and storage. Also, the design of the ironing board according to the present invention permits easy removal and reinstallation to another drawer, for example for the sake of convenience, or when moving to another residence altogether.

Other objects and advantages of the present invention will be more readily apparent from the following detailed description when read in conjunction with the accompanying drawings.

DETAILED DESCRIPTION OF THE INVENTION

Figure 1:
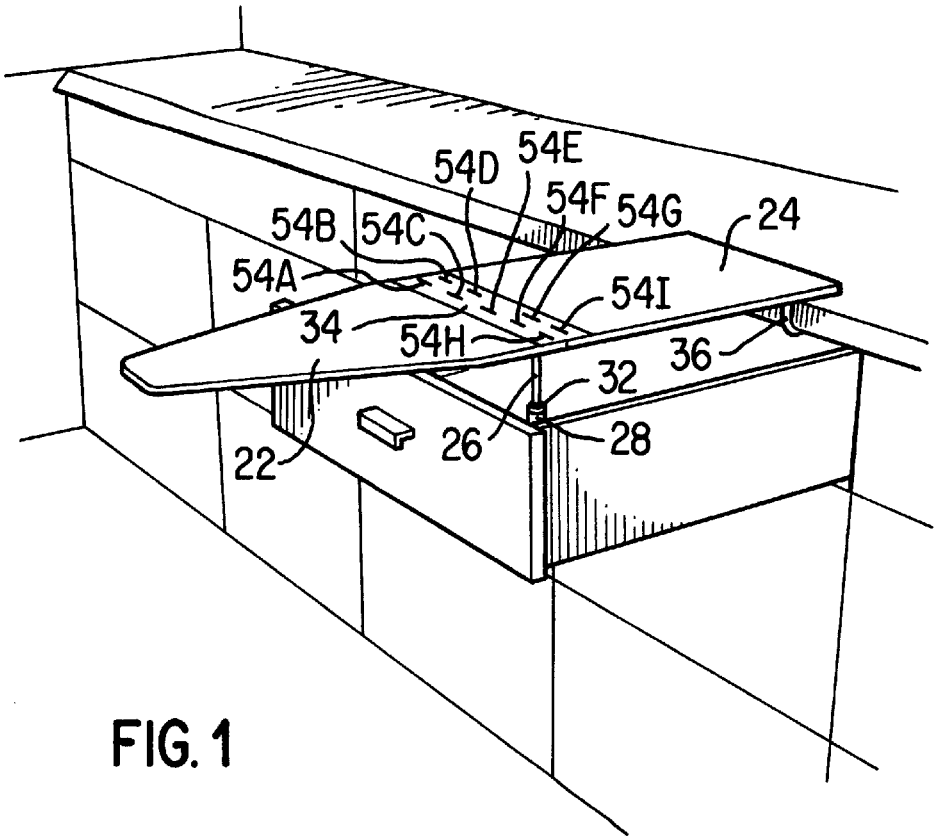
FIG. 1 is a perspective view of the ironing board according to the present invention in an extended, deployed position.

An ironing board apparatus 20 is illustrated in perspective view in FIG. 1. The ironing board apparatus 20 includes a tapered nose board 22, which is approximately 41 cm. long and 30 cm. wide, and a rectangular base board 24 which is approximately 41 cm. long and 30 cm. wide. The two boards 22 and 24 are attached by a polypropylene hinge 34, which is approximately 5 cm. wide by 30 cm. long, to thereby form a horizontal ironing surface.

The nose board 22 and the base board 24 in this embodiment are preferably made of particle board, available at any hardware or lumber supply store. The boards 22 and 24 may also be made of plywood, wood, metal, plastic, or other material. The hinge 34 is preferably affixed to the abutting edges of the nose board 22 and the base board 24 by contact cement and nine metal staples 54. Polypropylene strapping has the required characteristics of being durable and flexible without breaking or deforming, and it is compatible with a variety of contact adhesives, as is particle board, and is sufficiently flat to have no detrimental roughening effect on the smoothness of the ironing surface, once an appropriate ironing board cover has been attached.

It is noted that the drawings do not depict an ironing board cover 21, however such covers are conventional and well known and are therefore not further described herein. Such an ironing board cover 21 is an integral part of an operational ironing board apparatus 20, and would in practice be provided over the boards 22 and 24 in a known manner.

Figure 2:
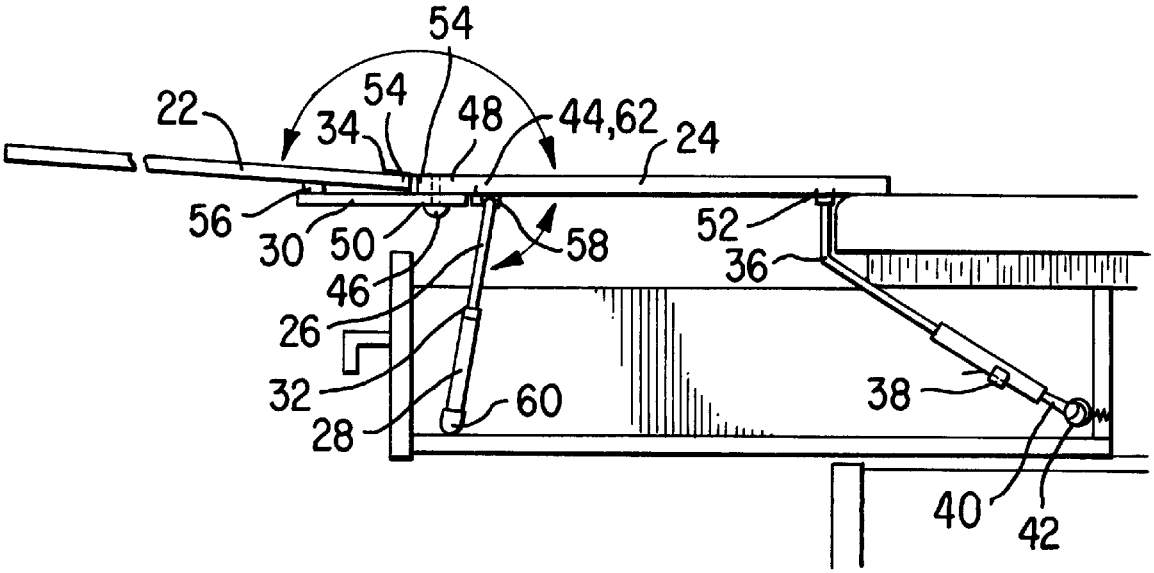
FIG. 2 is a side elevational view of the ironing board of FIG. 1, showing folding of a nose board and a vertical support member.

The nose board 22, as shown in FIG. 2, has only one other component attached, namely a sponge rubber bumper 56. The base board 24 has the remainder of the components attached, as follows.

Figure 6:
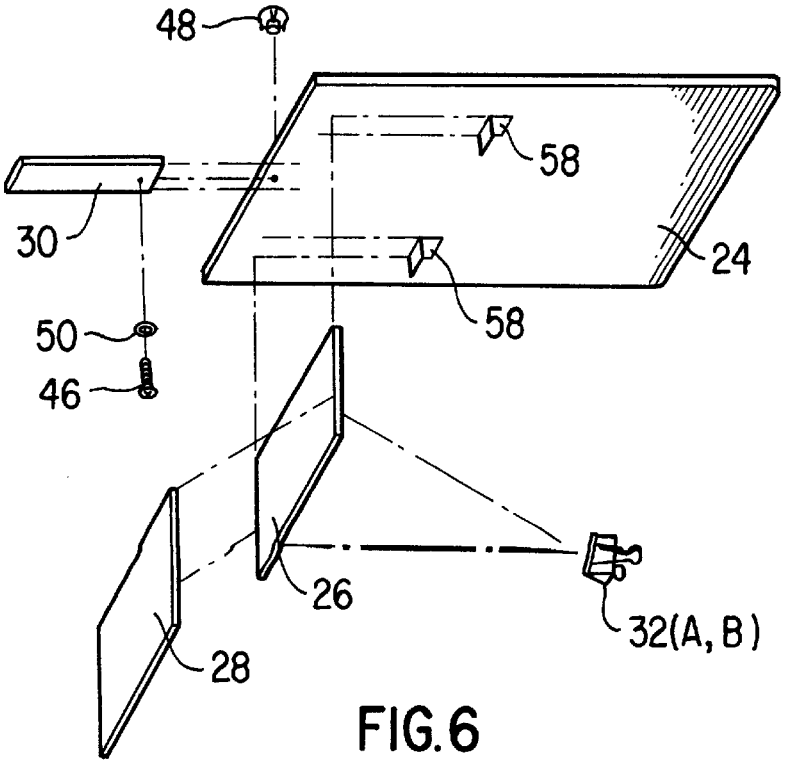
FIG. 6 is an exploded assembly view of the ironing board according to the present invention, showing horizontal and vertical support systems.

A horizontal support member 30 is pivotably attached to the underside of the base board 24 by a machine bolt 46, a lock washer 50, and a tee-nut 48, as shown in detail in FIGS. 2 and 6. The vertical support member 26 is affixed to the underside of the base board 24 by two polypropylene hinges 58, each approximately 5 cm. wide by 7 cm. long, each preferably attached to the base board 24 by contact cement and four metal staples 54, and one carpet tack 44.

FIGS. 2 and 6 also illustrate the attachment of a vertical adjustment member 28 to a vertical support member 26 by two binder clips 32. The horizontal support member 30 and the vertical support member 26 and vertical adjustment member 28 are preferably composed of particle board or plywood in this embodiment, but may also be made of plastic, metal, wood, etc. The rear end of the underside of the base board 24, as shown in FIG. 2, has affixed to it a section of elastic cord 36 approximately 25 cm. long, by two insulated staples 52.

As shown in FIGS. 2, 3, 4, and 5, a nylon tie 38 is looped and fastened around a section of elastic cord 36, and a lanyard snap 40 is connected to the looped nylon tie 38. An eye screw 42 is screwed into the rear side of the drawer, and the lanyard snap 40 is then connected to the eye screw 42.

From the above description, the advantages of the inventive ironing board arrangement are seen to be as follows.

It is constructed of inexpensive components which are readily available at hardware and/or lumber supply stores. It requires no complicated or expensive manufacture process for construction and assembly. The simplicity of the vertical adjustment process and the elastic cord-nylon tie-lanyard snap-eye screw components of the base stabilization system ensure that users can easily install and adjust the ironing board, and utilize it without difficulty. Also, the inventive ironing board offers greatly enhanced convenience to the user, in that the ironing board is more quickly deployed and put away, takes up no counter or floor space, and is completely out of sight when not deployed.

In operation, the special qualities of the ironing board according to the present invention include easy user installation and adjustment; quick deployability; covert storeability; and enhanced convenience. The installation thereof is accomplished as follows.

The eye screw 42 is detached from the lanyard snap 40 and screwed into the center of the rear panel of the inside of the drawer, preferably about 2 cm. from the bottom of the drawer.

Figure 3:
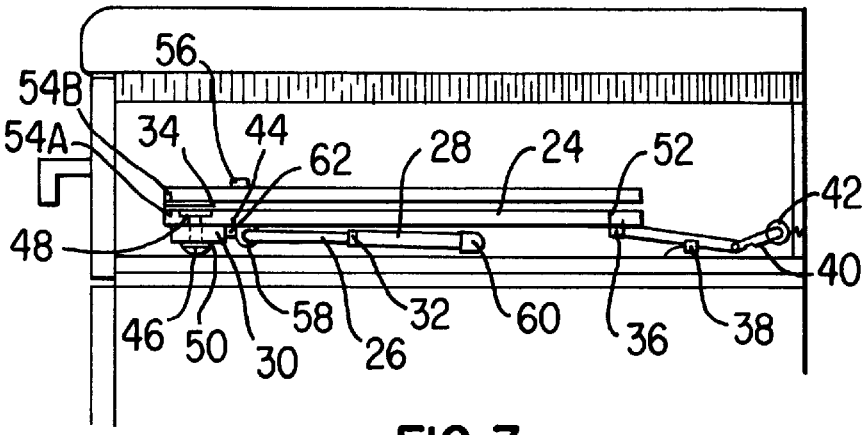
FIG. 3 is a side view of the ironing board according to the present invention in a stored position inside a drawer.
Figure 4:
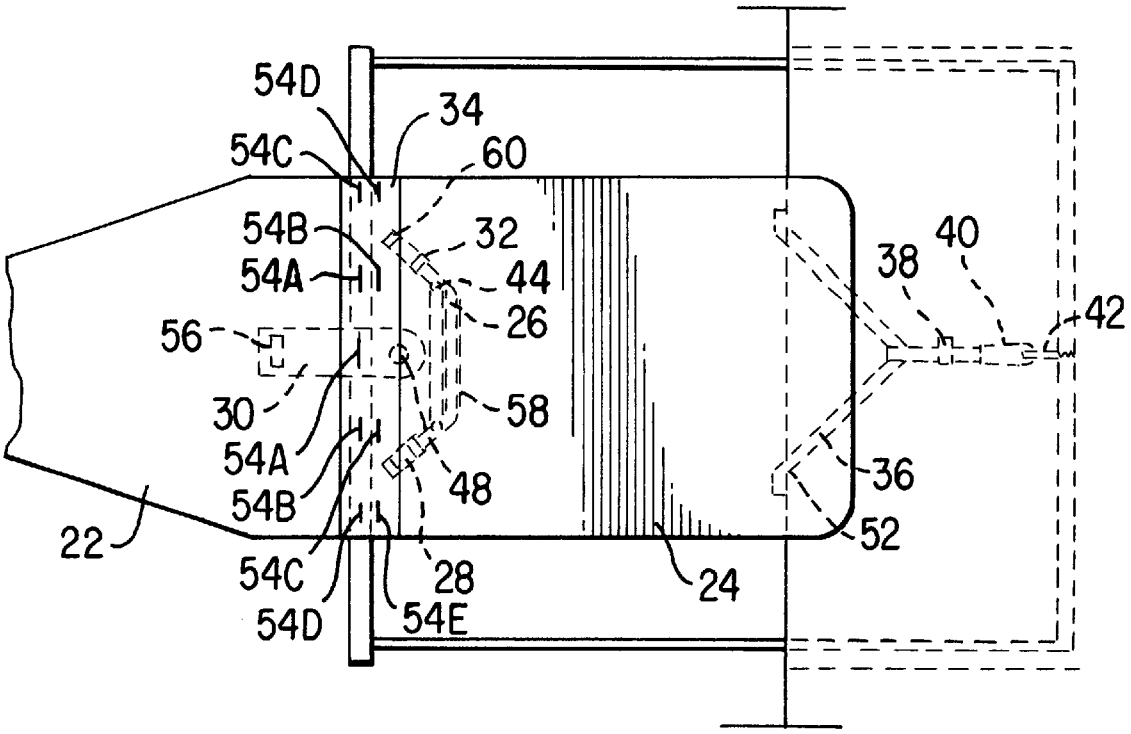
FIG. 4 is a top elevational view of the ironing board of FIG. 1 in a deployed state extending from a drawer.

The ironing board, folded as shown in FIG. 3, is placed into the drawer, and the lanyard snap 40 is reconnected to the eye screw 42.

The drawer is fully opened to its mechanical stop, and the board is lifted out of the drawer, the rear end of the base board 24 resting on the edge of the cabinet, counter, or dresser top.

In the event the drawer is of a type which does not have a mechanical stop, i.e., the drawer can be directly pulled out of the cabinet, the drawer should be pulled out far enough, approximately 31 cm. in this example, to allow the vertical support member 26 to be lowered into a vertical position without maling contact with the inside of the front side of the open drawer. The ironing board should then be adjusted to the open door, and marks should be placed on the top edges of the sides of the drawer so that the user will be able to open the drawer to the same position each time the ironing board is utilized. The previously-adjusted tension applied by the elastic cord 36 provides sufficient force such that the drawer will be maintained in this marked position whenever the ironing board is deployed.

The vertical support member 26 is manually pivoted forward at its hinge 58 to a vertical position, and the binder clips 32 are removed to allow for adjustment of the vertical adjustment member 28. The binder clips 32 are re-attached when the ironing board is observed as being level, the clips serving to hold the vertical adjustment member firmly to the vertical support member.

Figure 5:
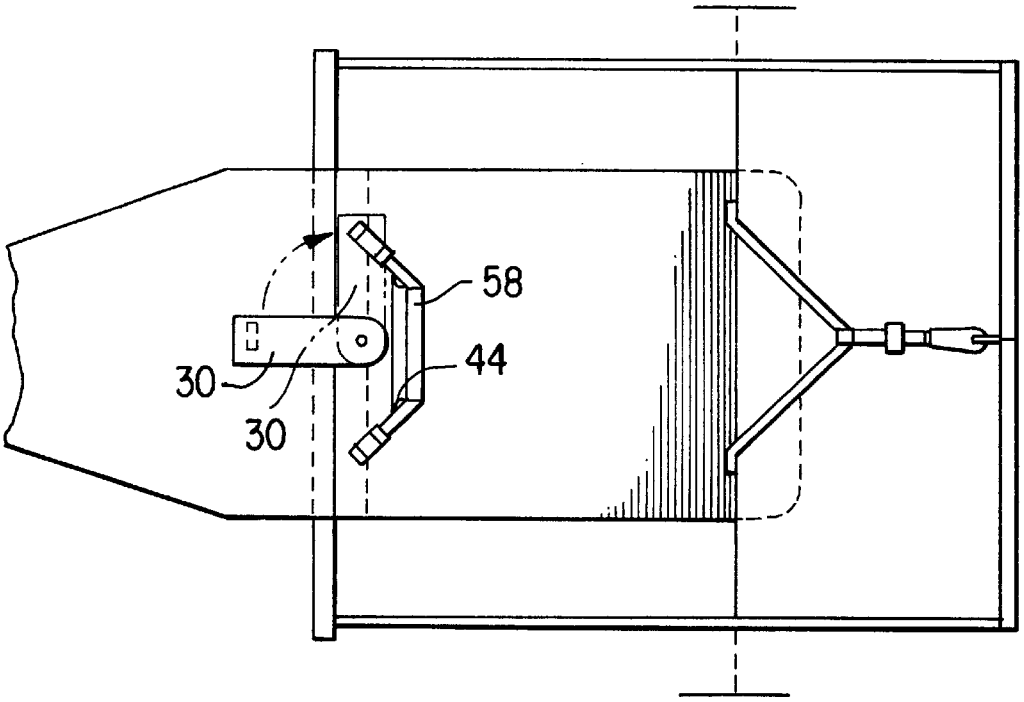
FIG. 5 is an elevational view seen from the bottom of the ironing board of FIG. 1, with the bottom of the drawer shown schematically partially in phantom outline.

The horizontal support member 30 is manually pivoted forward, as shown in FIG. 5, and the nose board 22 is manually lowered to a horizontal position, as in FIG. 2. The sponge rubber bumper 54 is sandwiched between the horizontal support member 30 and the nose board 22.

The end of the nylon tie 38 is pulled to shorten the length of the linkage, thus further stretching the elastic cord 36, until the resulting increased elastic tension creates sufficient force, downward and rearward, to firmly stabilize the rear end of the base board 24 on the counter-dresser-table top. While the elastic cord 36 provides adequate leeway, it is preferred that the user pull the nylon tie in short increments to avoid overtightening, since the nylon tie 38 is irreversible. The minimum tension which provides firm base board support is the optimum adjustment.

If required, the above three steps may be repeated to "fine tune" the horizontal leveling and base stabilizing adjustments.

The installation and adjustment procedures having been thus described, the operational use of the ironing board according to the present invention is described hereunder.

The user opens the drawer to observe the folded board, as shown in FIG. 3. The drawer is opened to its stop (or mark), and the folded board is lifted from the drawer and pulled toward the drawer front until the rear end of the base board 24 clears the drawer opening and can be set on the counter top, FIG. 2. The process of lifting and pulling the ironing board causes the elastic cord 36 to stretch, since it is connected via the linkage to the back side of the drawer, and the properly adjusted tension thus created, which is exerted in a downward and rearward direction, holds the rear end of the base board snugly to the counter top.

At the same time that the rear end of the base board 24 is set on the counter top, the user folds down the vertical support member 26 about its hinge 58 to a vertical position, then rotates the horizontal support member 30 to its extended position, as shown in FIG. 5. The rear corner of the extended horizontal support member 30 makes contact with and provides movement-limiting support to the vertical support member 26, as shown in FIG. 5.

The nose board 22 is manually lowered into place via its hinge 34. The nose board 22 is thus supported by the horizontal support member 30 and the sponge rubber bumper 56, as shown in FIG. 2.

To store the ironing board after use, the reverse of the above procedure is followed. The nose board 22 is manually folded up and back so that it rests on the base board 24. The horizontal support member 30 is manually rotated back, and the vertical support member 26 is then folded back while the base board 24 is being pulled off the counter top. The base board 24 is then lowered into the drawer, followed by the entire folded board, and the drawer is closed, as shown in FIG. 3.

The ironing board according to the present invention provides enhanced convenience to the routine home ironing process. In addition to its quick deployment and storage, the board provides a stable ironing platform. Additional advantages are: simple installation and adjustment by the user to any top drawer of choice in a cabinet, dresser, table, etc.; easy removal and relocation as required or preferred, thus permitting other use of the drawer space for other purposes; ease of construction and assembly; availability of parts and components at most hardware and lumber supply stores; it is economical to manufacture, and therefore can be economical to purchase; and it is suitable for wide distribution, rather than through custom cabinet supply outlets only.

It is noted that the present invention may be composed of a variety of basically interchangeable materials, such as metal, wood, plastic, etc., and all such variations are contemplated as being within the scope of the present invention.

The invention, as shown in FIGS. 7, 8, 9, 10, and 11, comprise most of the same principles as noted above. In this embodiment, the ironing board apparatus 20 includes a rectangular base board 24 having a first end 24*a* and a second end 24*b*, a first top side 24*c* and a first bottom side 24*d*The tapered nose board 22 has a third end 22*a*, and a distal tapered nose board end 22*b*, a second top side 22*c* and a second bottom side 22*d*. Preferably, the tapered nose board 22 is equal to or less than the length of the rectangular base board 24. The tapered nose board 22 and rectangular base board 24 are preferably made of material selected from particle board, plywood, plastic or metal.

A hinge portion 34 is secured between the second end 24*b* of the rectangular base board 24 and the third end 22*a* of the tapered nose board 22. The hinge portion 34 is preferably a continuous hinge portion. The hinge portion 34 is positioned to place the second top side 22*c* of the tapered nose board 22 adjacent to the first top side 24*c* of the rectangular base board 24 when in a folded position. When in an open position, the first top side 24*c* is in a substantially planar alignment with the second top side 22*c* of the tapered nose board 22. The hinge portion 34 is preferably a continuous hinge, such as a polypropylene hinge.

The support member 110 preferably has opposing, raised first and second curved rail portions 112, 113 secured to the first bottom side 24*d* of the rectangular base board 24. The first and second curved rail portions 112, 113 are sized to slidably receive a U-shaped slide member 120, having substantially parallel legs. The slide member 120 is sized to extend beyond the second end 24*b* of the rectangular base board 24 in the extended position to provide support for the bottom side 22*d* of the tapered nose board 22 when the tapered nose board is pivoted about the hinge portion 34 into an open position shown in FIG. 11. The slide member 120 is alternately positioned to retract beneath the first bottom side 24*d* of the rectangular base board when moved into a folded position.

The support member 110 also preferably includes a third, raised, curved rail portion 114 disposed between, and perpendicular to the first and second raised, curved rail portions 112, 113. The third raised, curved rail portion 114 is sized to pivotally receive a middle portion 132 of a generally U-shaped leg portion 130, having two inclined legs 134, 136.

An ironing board cover is preferably sized to be releasably secured upon the top side 22*c*, 24*c* of the tapered nose board and the rectangular base board, to provide a suitable ironing surface.

Figure 7:
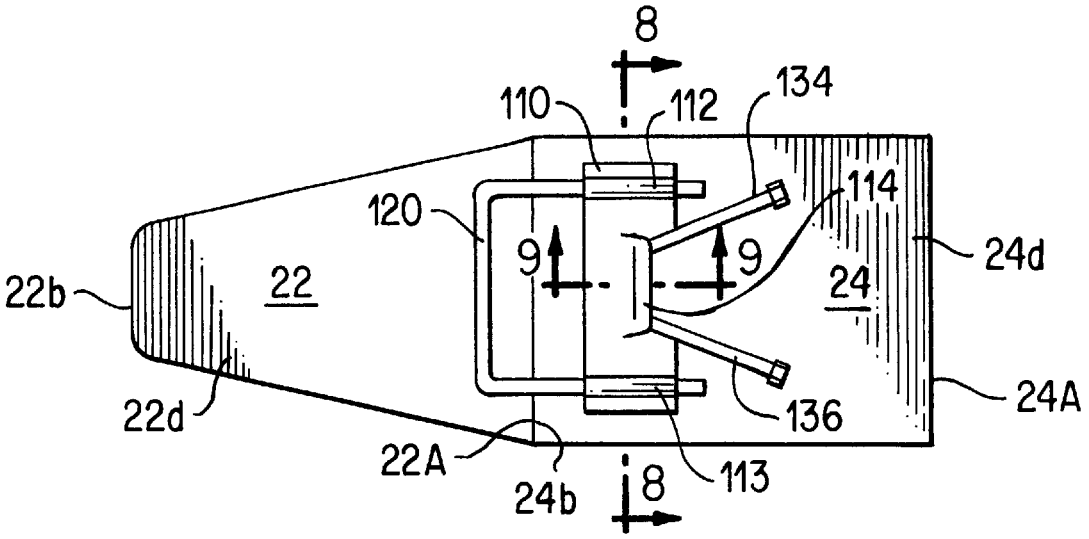
FIG. 7 is a bottom elevational view of a second embodiment of the present invention, showing a foldable ironing board.

Distinguishing features of the second embodiment as shown in FIG. 7 include a support member 110 which is rigidly and fixedly connected to the base board 24, the support member 110 having first and second opposing, raised, first and second curved rail portions 112, 113 secured to the first bottom side The support member 110 slideably supports movement of a U-shaped slide member 120 within the curved rail portions 112, 113. A generally U-shaped, movable support member 130, having two telescoping legs 134, 136 and a middle portion 132, is pivotably mounted in a third raised curved rail portion 114. Preferably, the third raised curved rail portion 114 is resiliently biased.

The support member 110 is preferably formed of metal, such as steel or aluminum. The support member 110 provides support for the nose board 22 when the U-shaped slide member is in its deployed condition (shown in FIG. 7). The U-shaped slide member 120 is likewise preferably formed of metal, such as steel or aluminum, as is the generally U-shaped movable support member 130. The slide member 120 and the movable support member 130 are both preferably formed from tubular stock material having a circular or tubular cross section, although other types of cross section may also serve, for example elliptical, hexagonal, and so on.

Figure 8:
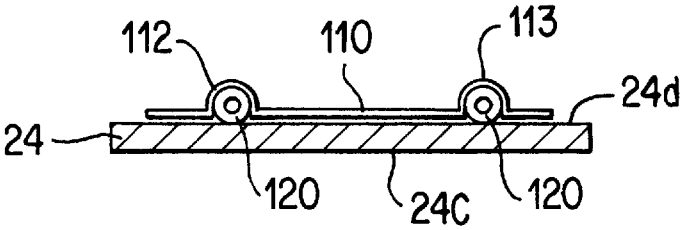
FIG. 8 is a sectional view taken along line 8—8 of FIG. 7.

FIG. 8 is a sectional view taken along line 8—8 of FIG. 7, and shows the manner in which the first and second curved rail portions 112, 113 of the support member 110 receive the parallel legs of the U-shaped slide member 120.

Figure 9:
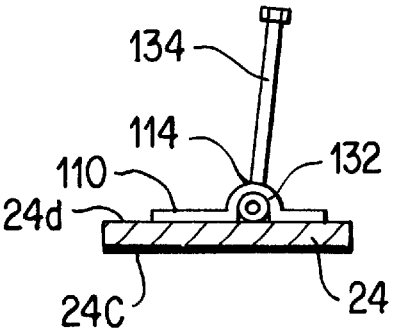
FIG. 9 is a sectional view taken along line 9—9 of FIG. 7.

FIG. 9 is a sectional view taken along line 9—9 of FIG. 7, and shows the manner in which a third curved leg support portion 114 of the support member 110 receives a tubular middle portion of the generally U-shaped movable support member 130. The raised, curved rail leg support portion 114 of the support member 110 is preferably slightly resiliently deformed when the movable support member 130 is inserted therein, to provide a functional force sufficiently strong to prevent unwanted movement by the movable support member 130 once it is manually positioned. The third raised curved rail portion is sized to pivotally receive the middle portion 132 of the U-shape movable support member 130. Preferably, the movable support member 130 is a U-shaped member having two inclined leg portions 132, 134.

Other types of support members 110 are contemplated as being within the scope of the present invention, for example a snap-locking member could be used to preferentially lock the movable support member 130 into either of two positions, an open, upright position for use (shown in FIG. 9, for example) and a closed, folded position (as shown in FIG. 7).

Figure 10:
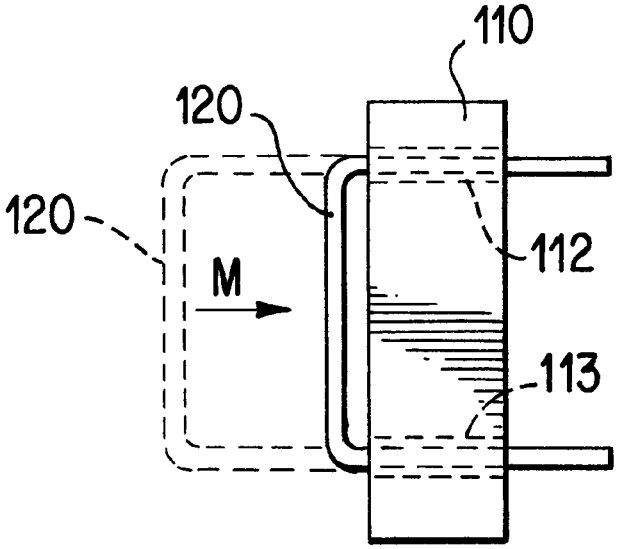
FIG. 10 is an elevational view schematically illustrating operation of a slide member shown in FIG. 7.

FIG. 10 is an elevational view schematically illustrating operation of a slide member 120 shown in FIG. 7. As seen in this view, the slide member 120 is shown in its open, deployed position (shown in phantom outline) which extends beyond the second end 24*b* of the rectangular base board 24 to provide support for the tapered nose board 22 when the tapered nose board is pivoted about the hinge portion into said open position. The slide member 120 is moved in a direction M toward its closed, collapsed position (shown in solid outline), so that it will not extend appreciably beyond the base board 24 when the nose board 22 is folded over the base board 24. This enables the rectangular base board 24 and the tapered nose board 22 to fit within an existing drawer, in a folded condition when not in use.

Figure 11:
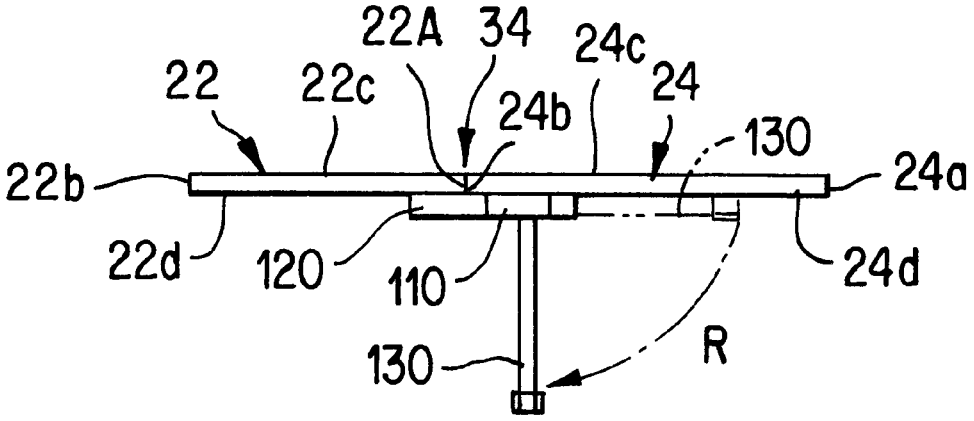
FIG. 11 is a side elevational view schematically illustrating operation of a movable support member shown in FIG. 7.

FIG. 11 is a side elevational view schematically illustrating operation of a movable support member 130 shown in FIG. 7. In this view, the movable support member 130 is shown being moved from its closed, folded condition (shown in phantom outline) in a rotational direction R toward the open, deployed position (shown in solid outline). The inclined legs 134, 136 may be adjustably secured to vary the length of the legs 134, 136, by any known means (not shown) to accommodate different existing drawer heights.

The invention being thus described, it will be evident that the same may be varied in many ways. Such variations are not to be regarded as a departure from the spirit and scope of the invention and all such modifications are intended to be included within the scope of the claims.

I claim:

1. A foldable ironing board apparatus, which comprises:

a) a drawer having a front portion, a rear portion, a bottom portion and opposing side portions;

b) a rectangular base board having a first end and a second end sized to be received within said drawer, said rectangular base board further having a first top side and a first bottom side;

c) a tapered nose board having a third end and a distal tapered nose board end, a second top side and a second bottom side, the tapered nose board also sized to be received within said drawer;

d) a hinge portion secured between the second end of the rectangular base board and the third end of the tapered nose board and positioned to place the second top side of the tapered nose board adjacent to the first top side of the rectangular base board in a folded position, and to position the second top side of the tapered nose board in a substantially planar alignment with the first top side of the rectangular base board when in an open position;

e) a slide member slidably secured within at least one raised curved rail portion secured to the first bottom side of the rectangular base board, the slide member positioned to extend beyond the second end of the rectangular base board to provide support for the tapered nose board when the tapered nose board is pivoted about the hinge portion into said open position, the slide member further positioned to retract beneath the first bottom side of the rectangular base board for ease of insertion of the foldable ironing board apparatus within said existing drawer in said folded position;

f) a generally U-shaped leg portion having a base portion and two inclined leg portions, the base portion pivotally secured to the first bottom side the rectangular base board, the U-shaped leg portion to support the first bottom side of the rectangular base board upon the bottom portion of said drawer in a raised position, and to pivot substantially parallel to the bottom side of the rectangular base board in a lowered position; and g) a resilient securement member having a first end and a second end, the resilient securement member secured at said first end to the first bottom side of the rectangular base board in proximity to the first end of the rectangular base board, the resilient securement member adjustably secured at said second end to the rear portion of said drawer.

2. The foldable ironing board apparatus of claim 1, wherein the hinge portion is a continuous hinge portion.

3. The foldable ironing board apparatus of claim 1, wherein the slide member has a circular cross sectional profile.

4. The foldable ironing board apparatus of claim 1, wherein the slide member has a tubular cross sectional profile.

5. The foldable ironing board apparatus of claim 1, wherein the length of the tapered nose board is equal to or less than the length of the rectangular base board.

6. The foldable ironing board apparatus of claim 1, wherein the rectangular base board and the tapered nose board are each made of a material selected from at least one of a particle board, a plywood, and a plastic.

7. The foldable ironing board apparatus of claim 1, wherein the hinge portion is a polypropylene hinge.

8. The foldable ironing board apparatus of claim 1, wherein an ironing board cover is sized to be releasably secured upon the top side of the rectangular base board and the top side of the tapered nose board, to provide a suitable ironing surface when the foldable ironing board is extended above said drawer.

9. A foldable ironing board apparatus, which comprises:

a) a rectangular base board having a first end and a second end, said rectangular base board further having a first top side and a first bottom side;

b) a tapered nose board having a third end and a distal tapered nose board end, a second top side and a second bottom side;

c) a hinge portion secured between the second end of the rectangular base board and the third end of the tapered nose board and positioned to place the second top side of the tapered nose board adjacent to the first top side of the rectangular base board in a folded position, and to position the second top side of the tapered nose board in a substantially planar alignment with the first top side of the rectangular base board when in an open position;

d) a slide member slidably secured within a raised, curved rail portion secured to the first bottom side of the rectangular base board, the slide member positioned to extend beyond the second end of the rectangular base board to provide support for the tapered nose board when the tapered nose board is pivoted about the hinge portion into said open position, the slide member further positioned to retract beneath the first bottom side of the rectangular base board in said folded position;

e) two adjustable inclined leg portions, pivotally secured to the first bottom side the rectangular base board, to adjustably position and support the first bottom side of the rectangular base board at a selected height above a bottom portion of a drawer in an open position, and to pivot substantially parallel to the bottom side of the rectangular base board in a closed position; and f) a resilient securement member secured at a first end to the first bottom side of the rectangular base board in proximity to the first end of the rectangular base board, the resilient securement member secured at a second end to a rear portion of said drawer.

10. The foldable ironing board apparatus of claim 9, wherein a support member is secured to the bottom side of the rectangular base board, and the support member includes opposing, raised, first and second curved rail portions positioned to slidably receive parallel sides of a U-shaped slide member within the opposing raised curved rail portions.

11. The foldable ironing board apparatus of claim 10, wherein the support member further includes a third raised, curved rail portion disposed between, and perpendicular to the first and second curved rail portions, the third raised curved rail potion sized to pivotally receive a pivotal portion of the two inclined leg portions.

12. The foldable ironing board apparatus of claim 9, wherein the hinge portion is a continuous hinge portion.

13. The foldable ironing board apparatus of claim 9, wherein the slide member has a circular cross sectional profile.

14. The foldable ironing board apparatus of claim 9, wherein the slide member has a tubular cross sectional profile.

15. The foldable ironing board apparatus of claim 9, wherein the length of the tapered nose board is equal to or less than the length of the rectangular base board.

16. The foldable ironing board apparatus of claim 9, wherein the rectangular base board and the tapered nose board are each made of a material selected from one of a particle board, a plywood, and a plastic.

17. The foldable ironing board apparatus of claim 9, wherein the hinge portion is a polypropylene hinge.

18. The foldable ironing board apparatus of claim 9, wherein an ironing board cover is sized to be releasably secured upon the top side of the rectangular base board and the side of the tapered nose board, to provide a suitable ironing surface when the foldable ironing board apparatus is positioned in an open position above said drawer.

19. A foldable ironing board apparatus, which comprises:

a) a rectangular base board having a first end and a second end, said rectangular base board further having a first top side and a first bottom side;

b) a tapered nose board having a third end and a distal tapered nose board end, a second top side and a second bottom side;

c) a hinge portion secured between the second end of the rectangular base board and the third end of the tapered nose board and positioned to place the second top side of the tapered nose board adjacent to the first top side of the rectangular base board in a folded position, and to position the second top side of the tapered nose board in a substantially planar alignment with the first top side of the rectangular base board when in an open position;

d) a support member having opposing, raised, first and second curved rail portions secured to the first bottom side of the rectangular base board, the support member further includes a third raised, curved rail portion disposed between, and perpendicular to the first and second curved rail portions;

e) a U-shaped slide member having substantially parallel legs slidably secured within said opposing, raised, first and second curved rail portion of the support member, the slide member positioned to extend beyond the second end of the rectangular base board to provide support for the tapered nose board when the tapered nose board is pivoted about the hinge portion into said open position, the slide member further positioned to retract beneath the first bottom side of the rectangular base board in said folded position;

f) a generally U-shaped leg portion, the base of the U-shaped leg portion pivotally secured to the third raised, curved rail portion of the support member, the generally U-shaped leg portion having inclined legs positioned to support the first bottom side of the rectangular base board in an open position above a drawer, and to pivot substantially parallel to the bottom side of the rectangular base board in a closed position; and g) a resilient securement member secured at a first end to the first bottom side of the rectangular base board in proximity to the first end of the rectangular base board, the resilient securement member secured at a second end to a rear portion of said drawer.

20. The foldable ironing board apparatus of claim 19, wherein the hinge portion is a continuous hinge portion.

* * * * *